US010238562B2

(12) United States Patent
Pirio et al.

(10) Patent No.: US 10,238,562 B2
(45) Date of Patent: Mar. 26, 2019

(54) UNIT FOR PROVIDING ASSISTANCE OR SERVICES TO A PATIENT

(71) Applicant: Hill-Rom SAS, Pluvigner (FR)

(72) Inventors: Clementine Pirio, Nantes (FR); Philippe Kaikenger, Pluvigner (FR); Philippe Legros, Pluneret (FR); Pascal Guguin, Brech (FR); Pauline Maraud, Basse Goulaine (FR)

(73) Assignee: Hill-Rom SAS, Pluvigner (FR)

( * ) Notice: Subject to any disclaimer, the term of this patent is extended or adjusted under 35 U.S.C. 154(b) by 347 days.

(21) Appl. No.: 15/050,834

(22) Filed: Feb. 23, 2016

(65) Prior Publication Data

US 2017/0239115 A1 Aug. 24, 2017

(51) Int. Cl.
*A61G 7/10* (2006.01)
*A61G 7/05* (2006.01)

(52) U.S. Cl.
CPC ..... *A61G 7/1019* (2013.01); *A61G 7/0503* (2013.01); *A61G 7/1017* (2013.01); *A61G 7/1025* (2013.01); *A61G 7/1044* (2013.01); *A61G 7/1051* (2013.01); *A61G 7/1073* (2013.01); *A61G 7/1076* (2013.01)

(58) Field of Classification Search
CPC .. A61G 7/0503; A61G 7/1073; A61G 7/1044; A61G 7/1038; A61G 7/1017; A61G 7/1019; A61G 7/1025; A61G 7/1051; A61G 7/1076; A61G 7/0533
See application file for complete search history.

(56) References Cited

U.S. PATENT DOCUMENTS 1,584,117 A * 5/1926 Mitchell ..... B66C 23/201 182/142
1,840,170 A * 1/1932 Neils ..... A47C 21/00 5/200.1
2,519,880 A * 8/1950 Boddy ..... A47B 49/004 108/141
3,026,079 A * 3/1962 Stack ..... A61G 7/0503 248/122.1

(Continued)

FOREIGN PATENT DOCUMENTS

CA 1 170 604 A1 7/1984
CA 1170604 A1 * 7/1984

(Continued)

OTHER PUBLICATIONS

EP Search Report for Application No. EP 15 30 5287, dated Aug. 11, 2015 (2 pages).

(Continued)

*Primary Examiner* — Robert G Santos
*Assistant Examiner* — David R Hare
(74) *Attorney, Agent, or Firm* — Barnes & Thornburg LLP

(57) ABSTRACT

A bedside unit provides assistance and/or services to a patient in a bed. The unit includes a first vertical tubular shaft fixed to the floor and a second tubular shaft arranged around the first shaft and moveable relative to the first shaft under the action of a height adjustment mechanism. The apparatus for providing assistance and/or services includes drawers, an overbed table and an egress bar which are arranged to be controllably pivotable about the second shaft. The unit also includes a patient transfer arm at the top of the first shaft and rotatable thereabout.

19 Claims, 5 Drawing Sheets

(56) References Cited

U.S. PATENT DOCUMENTS 3,077,613 A * 2/1963 Mayer ..... A61G 7/0533 212/179
3,104,399 A * 9/1963 Dalton ..... A61G 7/1003 254/4 C
3,889,910 A * 6/1975 Walters ..... A47B 23/007 248/122.1
3,994,030 A * 11/1976 Cassell ..... A61G 7/1003 4/563.1
4,253,207 A * 3/1981 Marcyan ..... A61G 7/0533 5/84.1
4,644,595 A * 2/1987 Daniel ..... A61G 7/0533 5/83.1
4,733,418 A * 3/1988 Luther ..... A61G 7/1003 4/562.1
4,847,930 A * 7/1989 Spath ..... A61G 7/0533 5/84.1
4,932,090 A * 6/1990 Johansson ..... A47K 17/024 5/662
5,058,848 A * 10/1991 Ferraro ..... A47B 23/007 248/444.1
5,199,680 A * 4/1993 Rivera ..... A47B 23/007 248/441.1
5,365,618 A * 11/1994 Gilbert ..... A61G 7/1003 248/200.1
5,586,352 A * 12/1996 O'Brien ..... A61G 7/053 248/200.1
5,651,595 A * 7/1997 Willis ..... A47B 49/004 109/67
6,068,225 A * 5/2000 O'Brien ..... A61G 7/053 248/200.1
6,138,301 A * 10/2000 Battiston ..... A61G 7/053 5/659
6,401,863 B1 * 6/2002 Kirkland ..... B66D 3/20 182/142
7,065,811 B2 6/2006 Newkirk et al.
7,178,181 B1 * 2/2007 Fulmer ..... A61G 7/1015 212/179
7,219,472 B2 5/2007 Gallant et al.
7,254,850 B2 8/2007 Newkirk et al.
7,434,278 B2 * 10/2008 White ..... A61G 7/1015 5/81.1 HS
7,536,738 B2 * 5/2009 Richards ..... A61G 7/0533 5/662
7,725,964 B2 6/2010 Minning et al.
8,348,211 B2 1/2013 Bauer
8,635,720 B2 * 1/2014 Aabakken ..... A61G 7/1044 5/83.1
8,683,750 B2 4/2014 Gallant et al.
8,684,136 B2 * 4/2014 Chilton ..... A62B 1/06 182/3
8,810,357 B2 8/2014 Bauer et al.
9,700,473 B2 * 7/2017 Rogge ..... A61G 7/1017
2005/0274572 A1 * 12/2005 Stelzer ..... A61G 12/00 182/36
2006/0016014 A1 1/2006 Thaxton
2007/0186348 A1 * 8/2007 Banks ..... A61G 7/0533 5/662
2010/0132114 A1 * 6/2010 Becker ..... A61G 7/1017 5/87.1

FOREIGN PATENT DOCUMENTS

EP 2 777 675 A1 3/2014
FR 2 634 647 A1 2/1990
GB 1 232 649 8/1968
JP 2001231823 A 8/2001

OTHER PUBLICATIONS

The Hill-Rom® 900 Bed, www.hill-rom.com, © 2013 Hill-Rom®, SARL (7 pages).

* cited by examiner

UNIT FOR PROVIDING ASSISTANCE OR SERVICES TO A PATIENT

The present application claims priority, under 35 U.S.C. § 119(a), of European Application No. 15305287.3 which was filed Feb. 25, 2015 and which is hereby incorporated by reference herein.

BACKGROUND

The present disclosure is concerned with a unit for providing assistance and/or services to a patient on a patient support apparatus such as a bed (whether a hospital bed or a long term care (LTC) bed), or chair. Patients (and/or their caregivers) in such environments require access to a number of different functionalities for comfort, entertainment and/or care. For example, the patient in a LTC bed and/or his caregiver is likely to require access to some if not all of the following near the bed:

- a patient lifting system to life the patient into and out of the bed,
- a display screen,
- an overbed table,
- a bedside cabinet with storage space,
- an egress bar to help the patient move in the bed, and/or egress from the bed,
- a bedside light,
- an intravenous (IV) drip pole, and/or
- an electrical socket.

Most of these functionalities are provided by separate units located in the room near the bed. A long term care (LTC) or hospital bed may be surrounded by at least the following separate units: a wall-mounted screen, a patient lifting cradle, a zimmer frame or other walking and bed egress aid, a drug storage and dispensing trolley, an IV (intravenous) pole and a bedside cabinet for the patient to store his/her possessions. This takes up significant amounts of space and therefore has clear cost, convenience and accessibility implications. Space is at a premium and often expensive in a hospital or other care facility; the provision of a number of different units takes up space and increases cost as well as making it awkward for a care giver to access the patient and clean around the various units.

GB 1,232,649 discloses a bed side cabinet including storage drawers. U.S. Pat. No. 8,348,211 discloses a ceiling mounted medical supply unit, and US 2006/0016014 discloses apparatus for supporting a patient during repositioning in the bed.

US 2006/0016014 discloses a system for supporting an individual during repositioning including a first substantially vertical shaft with a square cross-section fixed or fixable in position relative to the patient support apparatus, a shaft fixing for fixing the first shaft in position relative to the patient support apparatus; a second substantially vertical shaft with a square cross-section arranged around, coupled to and moveable in a vertical direction relative to the first shaft, and an actuator element connecting the first and second shafts for controllably moving the second shaft relative to the first shaft.

SUMMARY

The present disclosure in a first aspect provides a patient service unit for providing assistance and/or services to a patient in or on a patient support apparatus, the unit including: a first substantially vertical shaft with a vertical axis and being fixed or fixable in position alongside a patient support apparatus, a shaft fixing for fixing the first shaft in position relative to the patient support apparatus; a second substantially vertical tubular shaft arranged around, coupled to and moveable in a vertical direction relative to the first shaft, a height adjustment mechanism element connecting the first and second shafts for controllably moving the second shaft relative to the first shaft, and wherein the first shaft includes a patient transfer mechanism mounted thereon, and the unit includes at least one patient service element pivotably mounted to the second shaft for supplying assistance and/or services to a patient whereby the element for providing assistance and/or services to the patient is pivotable about the first fixed shaft, and moveable in a vertical direction relative to the first fixed shaft.

The inventors of the subject application are the first to appreciate that such an arrangement allows one to use the height adjustment mechanisms associated with modern patient support apparatus to transfer a patient using a simple and inexpensive patient transfer mechanism which takes up a relatively small amount of space near a patient support apparatus such as a hospital bed or a chair and also allows one to provide ancillary or desirable other patient assistance and/or services.

The present disclosure in a second aspect provides patient service unit for providing assistance and/or services to a patient in or on a patient support apparatus, the unit including: a first substantially vertical shaft having a vertical axis and being fixed or fixable in position relative to the patient support apparatus, a shaft fixing for fixing the first shaft in position relative to the patient support apparatus; a second substantially vertical tubular shaft arranged around, coupled to and moveable in a vertical direction relative to, the first shaft, a height adjustment mechanism element connecting the first and second shafts for controllably moving the second shaft relative to the first shaft, and wherein the second tubular shaft includes at least one mounting comprising a first curved bearing surface, the first bearing surface supporting a second bearing surface moveable relative to the first bearing surface to pivot about the vertical axis of the first shaft, the second bearing surface being coupled to a patient service element for providing assistance and/or services to a patient, whereby the patient service element is pivotable about the first and second shafts, and moveable in a vertical direction relative to the first shaft.

The inventors of the subject invention are the first to appreciate that the arrangement of two shafts with one controllably moveable in a vertical direction relative to the other fixed shaft, together with the provision of the at least one mounting on the described bearing arrangement allows one to provide a unit which can support and provide a number of different necessary or desirable patient or caregiver functionalities in a manner which takes up a lower amount of space and at reduced cost.

In an embodiment, the bearing surfaces are substantially circular and the second bearing surface extends around the first bearing surface. This results in an effective, easy to make bearing.

In an embodiment, the first bearing surface is a layer or coating on the surface of the second shaft and the second bearing surface is at least part of the internal circumferential surface of a curved member surrounding or extending partially around the second shaft.

In an embodiment at least part of a bearing surface is made from a low friction plastics material such as polyoxymethylene (POM or Acetal).

In an embodiment, the unit comprises a plurality of mountings each supporting apparatus for providing assistance and/or services. This allows a single unit to provide different functionalities and a single actuation to control the height of a number of elements. Such a unit takes up less space and is likely to be cheaper than the prior art systems with entirely separate units.

In an embodiment, the unit comprises first and second shafts each having a substantially circular horizontal cross-section.

In an embodiment, the second shaft is arranged outside the first shaft, the height adjustment mechanism is a linear actuator with a first end fixed relative to the first shaft and having the end of a controllably moveable rod or other linearly extendable element fixed to the second shaft so as to controllably move the second shaft relative to the first.

In an embodiment, the height adjustment mechanism is a gas spring. This makes for an inexpensive and effective height adjustment mechanism.

In an embodiment, the first and second shafts are each hollow tubes with a circular cross-section, the second shaft is arranged outside the first shaft and is slidable thereover, and wherein the second shaft includes an internal height adjustment fixing for engagement and movement with the moveable portion of the height adjustment mechanism such that movement of the height adjustment mechanism moves the internal height adjustment fixing and hence the second shaft relative to the first shaft.

In an embodiment, the internal height adjustment fixing is supported on substantially horizontal arms coupled to the second shaft and passing through substantially vertical slots in the first shaft.

In an embodiment, the unit includes a fixing plate for fixing the bottom of the first shaft to the floor or ground. This allows the space under and around the unit (which may have a plurality of functionalities) to be easily cleared.

In an embodiment, the element or elements for providing assistance and/or services includes or comprises one or more of a patient transporting or lifting system, a patient or care-giver screen, an overbed table, an egress bar for aiding egress from or movement on the patient support apparatus, a bedside cabinet, a drawer unit, an intravenous drip support pole and/or an electrical power supply socket.

In an embodiment, the apparatus for providing assistance and/or services includes a patient lifting system fixed to the top of the first shaft and pivotable about the first shaft.

In an embodiment, the unit includes a storage drawer mounted on one or more respective bearings mounted on the second shaft, and a drawer unit enclosure mounted around the storage drawer and fixed in position relative to the second shaft.

In an embodiment, the unit includes a patient transfer arm for supporting a sling bar and associated sling lift, the patient transfer arm being connected to the first shaft and arranged for rotation with or about the first shaft.

In an embodiment, the patient transfer arm is connected to the top or upper portion of the first shaft and rotatable thereabout.

In an embodiment the unit is a bed side unit or item of furniture.

BRIEF DESCRIPTION OF THE DRAWINGS

Embodiments of the invention will now be described by way of non-limiting example with reference to the attached figures, in which.

DETAILED DESCRIPTION

The terms "horizontal", "vertical", "top" and "bottom" and other terms used to describe the orientation and/or relative positions of elements of the unit refer to the unit when it is arranged for use in a patient care environment.

The expression "providing assistance and/or services" encompasses providing a functionality or service of use to a patient or caregiver. This includes, for example, providing storage space (e.g. using a drawer unit), providing support (e.g. an egress bar), providing an eating or working surface (e.g. an overbed table) as well as providing access to medical or patient care equipment and services (e.g. an IV pole or patient transfer system).

Figure 1:
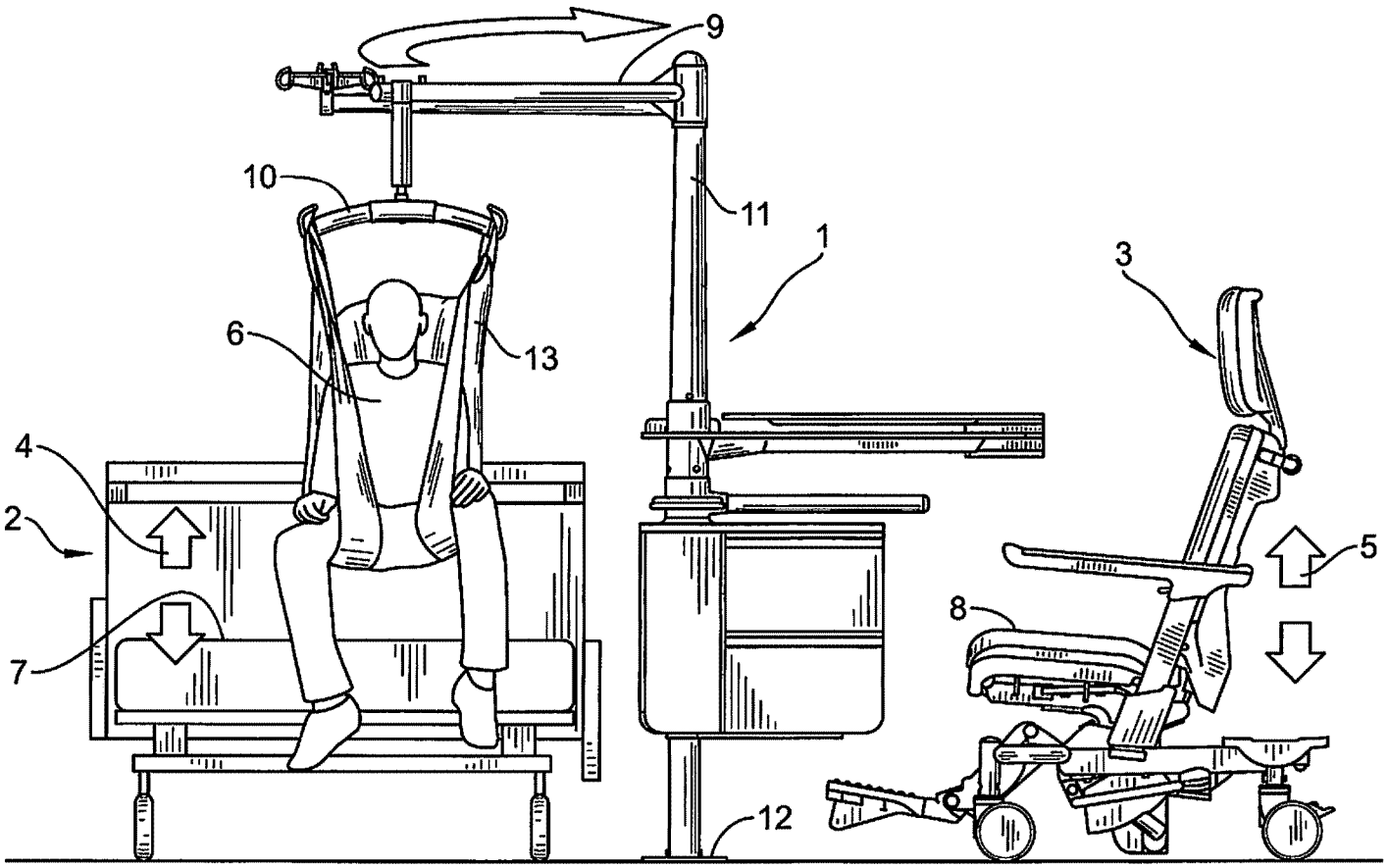
FIG. 1 shows a unit according to the present invention being used to transfer a patient from a bed to a chair.
Figures 2A, 2B:
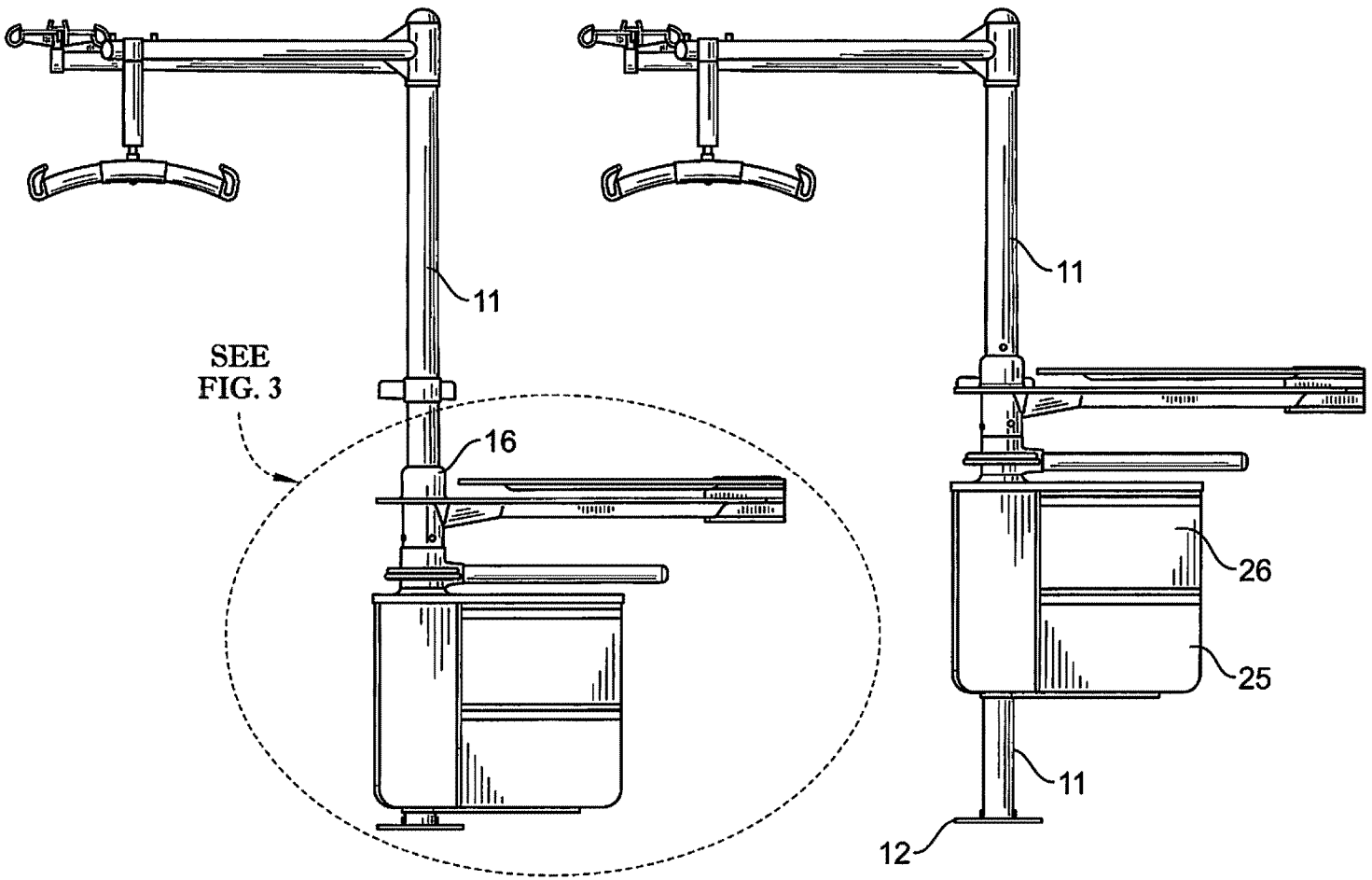
FIGS. 2*a* and 2*b* show the unit in, respectively, its lowered and raised position.

Referring to FIG. 1, a patient assistance unit 1 is fixed adjacent a hospital or long term care (LTC) bed 2 and may also be used in conjunction with a mobility chair 3. The bed and chair both include so-called HiLo actuators to controllably alter the height of their respective patient support surfaces 7, 8. Those actuators (not shown) move the bed support surface 7 and chair support surface 8 as shown by the respective pairs of arrows 4, 5. The bed 2 and chair are standard and well-known apparatus which will not be described further. An example bed might be the HR900 bed available from Hill-Rom, and an example chair might be the Anatome chair also available from Hill-Rom. Anatome is a trade mark of Hill-Rom. All medical beds or chairs with controllable height are suitable for use with the described embodiment.

The unit may be a bedside or chair side unit. The unit is suitable for location alongside a patient and/or caregiver in any patient environment in which it is desirable to provide functionalities to a patient or caregiver at different heights and/or positions In FIG. 1, the unit is being used to transfer a patient 6 between the bed and chair. The unit 1 includes a patient transfer arm 9 which supports a sling bar 10 on which is suspended a lift sling 13. Sling bars and lift sling systems are known and will not be described in detail. An example sling bar system might be that described in EP 2,777,675.

The unit 1 includes a first vertical shaft 11 fixed to the floor by a fixing plate 12. The fixing plate may be screwed to the floor. In alternative embodiments, the vertical shaft may be fixed in position by being fixed to the ceiling and/or the wall. If fixed to the wall, an additional horizontal fixing element would be required.

The patient transfer arm 9 is rotatably mounted to the top of the first shaft such that the arm 9 and its associated sling bar 10 and lift sling 13 may be rotated together with a patient 6 supported in the lift sling 13. A patient is transferred between the bed and chair using the sling lift of the unit as follows.

The lift sling is arranged around the patient as he or she is in the bed or chair with the respective bed or chair being in a raised position such that the sling lift can then be mounted on the sling bar without the sling lift being in tension and significant effort being necessary to lift the patient into position. Once the patient is in the sling lift and this is mounted on the sling bar, the bed or chair on which the patient is supported is lowered so that the weight of the patient is gradually taken up by the sling bar and associated patient transfer arm. Once the bed or chair from which the patient is being transferred is sufficiently clear of the patient in the sling lift, a caregiver can easily pivot the sling lift away from the respective bed or chair until the patient is over the lowered destination bed or chair he or she is being transferred to. Once the destination chair is arranged in position under the sling lift, that bed or chair may be raised into position until it takes the patient weight and the sling lift may then be removed from the patient. This arrangement makes use of the height change functionality of the bed and chair and does not require additional height change functionality on the patient transfer unit itself.

Figure 4B:
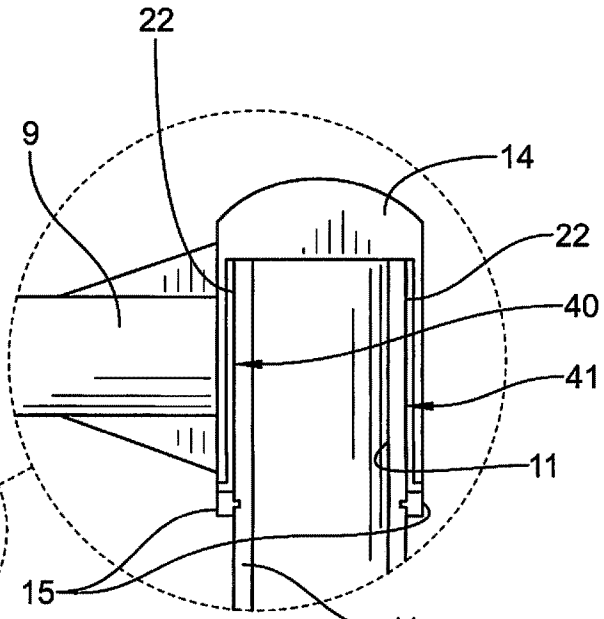
FIGS. 4*a* and 4*b* illustrate the construction of the coupling between the top of the patient transfer arm and the first shaft.
Figure 4A:
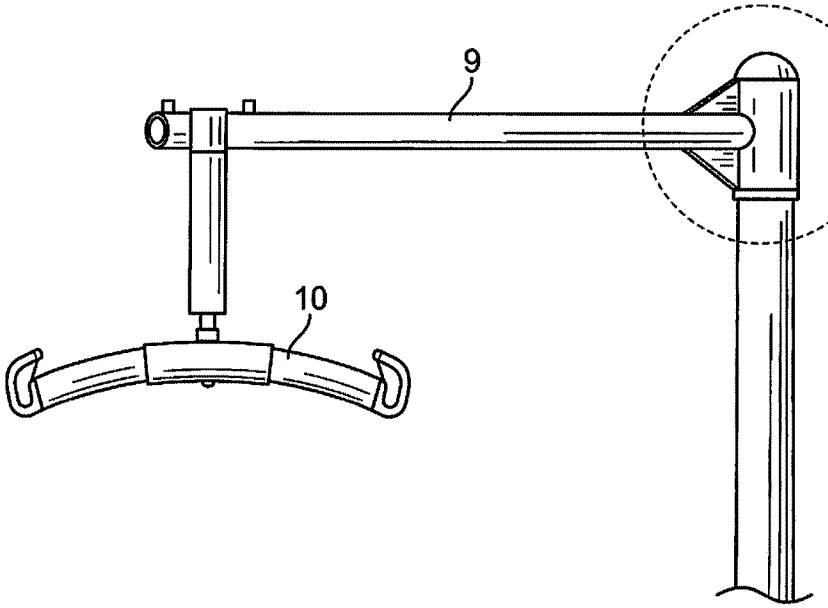

Referring to FIGS. 4*a* and 4*b*, the substantially horizontal patient transfer arm 9 is fixed to a rotatable cap coupling 14 at its end proximal the first shaft, and supports the sling bar 10 at its distal end. The bottom edges of the cap 14 are supported on a substantially T-shaped ring element 15 fixed to the outside surface of the first shaft. In the illustrated embodiment, the arm, shaft and ring element are made of a suitable metal such as stainless steel. The internal circumferential surface 40 of the cap 14 has a coating or layer 22 of a low friction material which defines a bearing surface which supports the cap 14 on the ring 15 and allows it to rotate relative to the outer surface 41 of the first shaft 11. The low-friction material may be acetal (i.e. polyoxymethylene or POM).

Figure 5:
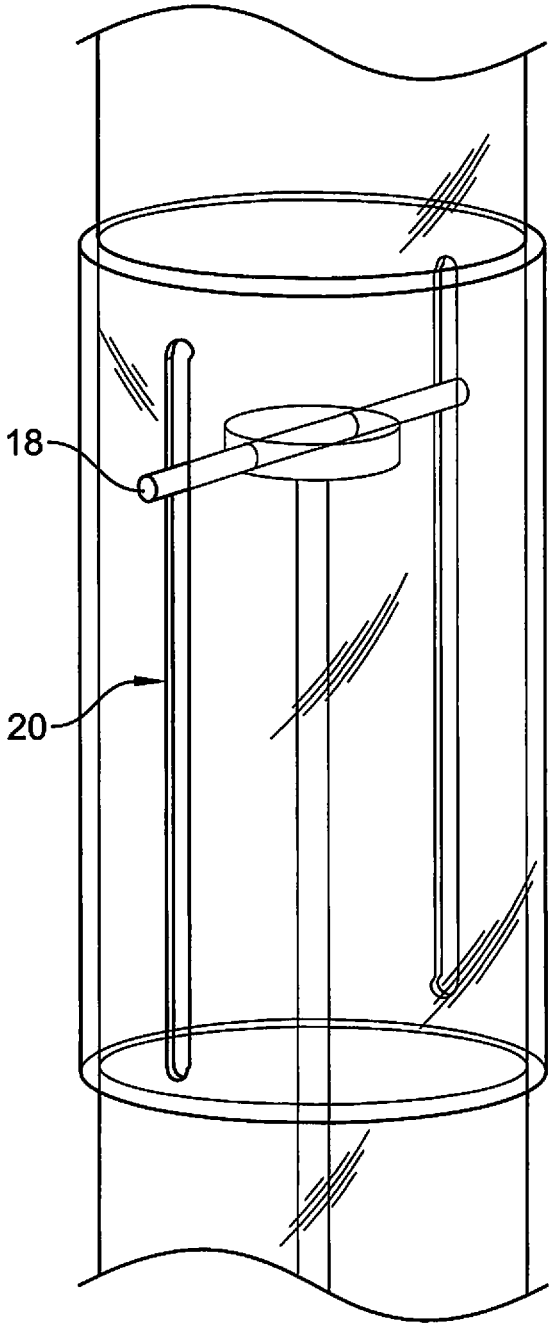
FIG. 5 illustrates a detail of the fixing for the top of the actuator rod.

Referring to FIGS. 1, 2*a*, 2*b* and 3, a second shaft or tube 16 is located around the first shaft. This rotatable second shaft is made of steel and includes an internal horizontal fixing element 17 which connects the upper internal sides of the second shaft 16. The fixing element 17 includes arms or screws 18 which fix an internal cross-piece 19 to the second shaft. The arms or screws 18 run in vertical slots 20 in the first shaft (see FIG. 5). A height adjustment mechanism allowing centralized raising or lowering of the cross-piece 19 and hence of the second shaft is provided inside the circular cross-section tubes defining the two shafts 11, 16. A first moveable end 23 of the height adjustment mechanism 21 engages and is fixed in or on the cross-piece 19, and a second fixed end 24 of the actuator is fixed to the base of the first shaft height adjustment mechanism. Controlled movement of the moveable end 23 of the height adjustment mechanism which engages the fixing element cross-piece 19 thereby allows for controllable movement of the second shaft relative to the first shaft, with the arms or screws 18 moving in the slots 20 as the second shaft moves relative to the first. The length of the slots 20 and the extent of travel of the moveable linear actuator element are chosen to allow the unit to move vertically a similar extent to the vertical movement of the bed or chair with which it is used. This is a similar extent of travel to existing overbed tables such as the TA 270 bed available from Hill-Rom. Any controllable height adjustment mechanism arrangement which allows for the controllable movement of a first surface relative to a second surface is suitable. In an embodiment according to this disclosure the height adjustment mechanism could be a controllable gas spring. To raise the height of the second shaft, a manually operable lever or moveable element is pulled to power the gas spring and hence act to push the second shaft upwards and help a patient or caregiver pull the second shaft upwards. To lower the height of the second shaft, a contact element or control (which might be below the overbed table 28 described below) would be engaged to deactivate the gas spring and allow the second shaft to drop down under gravity (and/or be pushed down by a patient or caregiver) until it reaches the desired height. This gas spring mechanism is similar to those which is well known for adjusting the height of chairs. Alternatively, the height adjustment mechanism 21 could be a linear activator controlled by buttons on one of the shafts 11, 16 or a separate rest control elsewhere as the unit on the bed.

Figure 3:
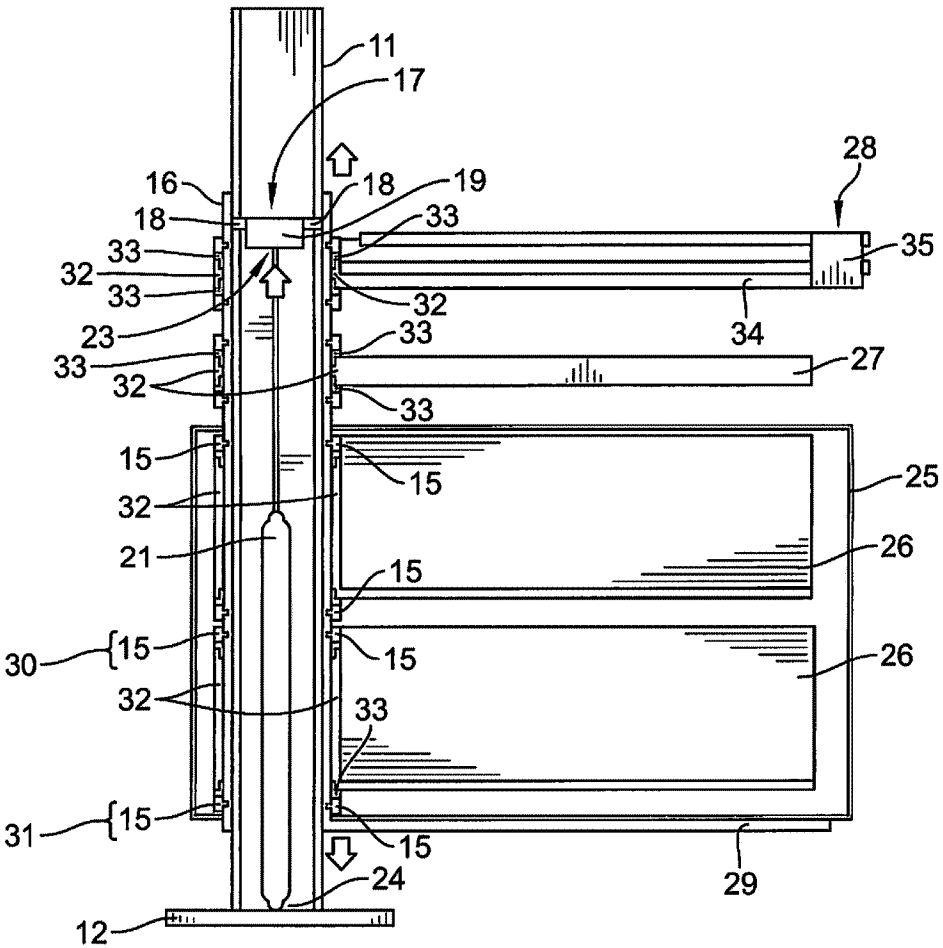
FIG. 3 is a vertical cross-section through the bottom portion A of FIG. 2*a;*

A plurality of elements which may be necessary to aid or supply services to a patient are arranged on the unit. Referring to FIG. 3, these include a drawer cabinet 25 including a pair of drawers 26, an egress bar 27 and an overbed table 28. Although not shown in the embodiment illustrated in FIG. 3 further or alternative elements might include an electrical socket or power point (to, for example, charge electronic devices and/or phones), a screen support or mount for a screen for use by a patient and/or caregiver, a bedside light and a monkey bar.

The drawer cabinet 25 is fixed to the second shaft. The top of the drawer cabinet is fixed to the walls of the second shaft and its base is supported on and fixed to, a drawer cabinet support arm 29 which projects from the bottom of the second shaft. The body of the drawer cabinet 25 could be of plastics or wood, and the cabinet support arm 29 of steel. The drawer cabinet is arranged so as to not rotate relative to the second shaft but only move with it as it is raised and lowered by movement of the height adjustment mechanism 21. The two drawers 26 are rotatably connected to the second shaft 16. Each drawer unit includes a tubular metal element 32 with a circular cross-section and which surrounds and is supported by the second shaft 16 (which also has a circular cross-section).

A pair of metal ring elements 15 are fixed to the second shaft and define upper 30 and lower 31 fixings for the drawer unit 26 to thereby hold it in position relative to the second shaft. Circular low friction bearing elements 33 extending around and fixed to the top and bottom edges of tubular elements 33 and having a substantially L-shaped cross-section contact the second shaft 16 and support rings 15 to define the bearing contact surface for the bearing between the second shaft 16 and the tubular element 33. At least part of the bearing surface 33 on the drawer unit which engages the outer bearing surface of the second shaft is made from a low friction material such as acetal (polyoxymethylene).

The egress bar 27 is a steel bar or rod with a plastics coating and, at its end proximal the second shaft, includes a tubular metal element 32 similar to that described above for the drawers 26. The tubular metal element is rotatable relative to the second shaft and rotatably connected to the second shaft and hence the unit in the same manner described above for the drawers 26.

The egress bar 27 is arranged so as to be slightly inclined relative to the vertical shafts 11, 16. This is so as to help the hand of a patient using it from, for example, a position in the bed 2 adjacent the unit 1 to have his or her hand in a position with a straight wrist.

The egress bar 27 also includes a mechanism (not shown) for locking it in one or more possible positions relative to the shaft 16 around which it rotates.

The overbed table 28 includes a steel support element 34 which includes at its end proximal the second shaft a tubular metal element 32 similar to those described above for the drawers 26 and egress bar 27. It is rotatably connected in the same way to the second shaft 16. The overbed table support element 34 supports on its upper surface an overbed table surface 38. The overbed table is in two parts connected by an overbed table pivot 35 so that the table may be unfolded when in use.

The drawer cabinet box 25, drawers 26, egress bar 27 and overbed table 28 all move up and down and relative to the first shaft (and the floor on which it is fixed) as the height adjustment mechanism 21 moves the second shaft 16 up and down. This allows a patient or caregiver to control the height of these elements to reflect the height of an adjacent bed 2 and/or chair 3 as that is changed. When a patient or caregiver wishes to, for example, access a drawer 26 the second shaft 16 is raised or lowered to a convenient height before the drawer 26 is rotated out from the cabinet box 25 (which is fixed relative to the second shaft 16) to allow access to the drawer 26. Similarly if the patient or caregiver requires the egress bar 27 to help the patient move him or herself, the height adjustment mechanism 21 is used to move it to a convenient height from where it is pivoted into position. The egress bar 27 may include a locking arrangement to lock it into position when it has been rotated into a desirable position. The overbed table 28 is moved into position in a similar manner, with the height adjustment mechanism 21 raising it into a desired height before it is then rotated out and then unfolded about the overbed pivot 25.

Although certain illustrative embodiments have been described in detail above, variations and modifications exist within the scope and spirit of this disclosure as described and as defined in the following claims.

The invention claimed is:

1. A patient service unit for providing assistance and/or services to a patient in or on a patient support apparatus, the unit including:

a first substantially vertical shaft with a vertical axis and being fixed or fixable in position alongside a patient support apparatus, a shaft fixing for fixing the first shaft in position relative to the patient support apparatus;

a second substantially vertical tubular shaft arranged around, coupled to and moveable in a vertical direction relative to the first shaft, and a height adjustment mechanism located inside the first shaft and connecting the first and second shafts for controllably moving the second shaft relative to the first shaft, wherein the height adjustment mechanism is arranged to telescopically extend and retract vertically inside the first shaft along the vertical axis to move the second shaft, wherein the first shaft includes a patient transfer mechanism mounted thereon, and the unit includes at least one patient service element pivotably mounted to the second shaft for supplying assistance and/or services to a patient whereby the element for providing assistance and/or services to the patient is pivotable about the first fixed shaft, and moveable in a vertical direction relative to the first fixed shaft.

2. A patient service unit according to claim 1 wherein the patient service element is one of a patient or care-giver screen, an overbed table, an egress bar for aiding egress from, ingress to or movement on the patient support apparatus, a bedside cabinet, a drawer unit, a drawer, an intravenous drip support pole and/or an electrical power supply socket.

3. A patient service unit according to claim 1 wherein the patient transfer mechanism includes a patient transfer arm for supporting a sling bar and associated sling lift.

4. A patient service unit for providing assistance and/or services to a patient in or on a patient support apparatus, the unit including:

a first substantially vertical shaft having a vertical axis and being fixed or fixable in position relative to the patient support apparatus, a shaft fixing for fixing the first shaft in position relative to the patient support apparatus;

a second substantially vertical tubular shaft arranged around, coupled to and moveable in a vertical direction relative to, the first shaft, and a height adjustment mechanism located inside the first shaft and connecting the first and second shafts for controllably moving the second shaft relative to the first shaft, wherein the height adjustment mechanism is arranged to telescopically extend and retract vertically inside the first shaft along the vertical axis to move the second shaft, wherein the second tubular shaft includes at least one mounting comprising a first curved bearing surface, the first bearing surface supporting a second bearing surface moveable relative to the first bearing surface to pivot about the vertical axis of the first shaft, the second bearing surface being coupled to a patient service element for providing assistance and/or services to a patient, whereby the patient service element is pivotable about the first and second shafts, and moveable in a vertical direction relative to the first shaft.

5. A patient service unit according to claim 4 wherein a patient transfer mechanism is mounted on the first fixed shaft.

6. A patient service unit according to claim 4 wherein the patient service element is one of a patient or care-giver screen, an overbed table, an egress bar for aiding egress from, ingress to or movement on the patient support apparatus, a bedside cabinet, a drawer unit, a drawer, an intravenous drip support pole and/or an electrical power supply socket.

7. A patient service unit according to claim 4 wherein the bearing surfaces are substantially circular and the second bearing surface extends around the first bearing surface.

8. A patient service unit according to claim 4 wherein the first bearing surface is formed on or by the surface of the second shaft and the second bearing surface is at least part of the internal circumferential surface of a curved member surrounding or extending partially around the second shaft.

9. A patient service unit according to claim 4 wherein at least part of a bearing surface is made from a low friction plastics material.

10. A patient service unit according to claim 4 including a plurality of patient service elements pivotable about the first and second shafts, and moveable in a vertical direction relative to the first shaft.

11. A patient service unit according to claim 10 wherein the patient service element is one of a patient or care-giver screen, an overbed table, an egress bar for aiding egress from, ingress to or movement on the patient support apparatus, a bedside cabinet, a drawer unit, a drawer, an intravenous drip support pole and/or an electrical power supply socket.

12. A patient service unit according to claim 4 wherein the first and second shafts each have a substantially circular horizontal cross-section.

13. A patient service unit according to claim 4 wherein, the height adjustment mechanism is a linear actuator with a first end fixed relative to the first shaft and having the end of its controllably moveable rod or other linearly extendable element fixed to the second shaft so as to controllably move the second shaft relative to the first.

14. A patient service unit according to claim 4 wherein the height adjustment mechanism is a controllable gas spring with a first portion fixed relative to the first shaft and a second portion fixed to the second shaft so as to controllably move the second shaft relative to the first shaft.

15. A patient service unit according to claim 4 wherein the first and second shafts are each hollow tubes with a circular cross-section, the second shaft is arranged outside the first shaft and is slidable thereover, and wherein the second shaft includes an internal height adjustment fixing for engagement and movement with the moveable portion of the height adjustment mechanism such that the height adjustment mechanism moves the internal height adjustment fixing and hence the second shaft relative to the first shaft.

16. A patient service unit according to claim 15 wherein the height adjustment fixing is supported on substantially horizontal arms coupled to the second shaft and passing through substantially vertical slots in the first shaft.

17. A patient service unit according to claim 4 including a fixing plate for fixing a bottom of the first shaft to a floor or ground.

18. A patient service unit according to claim 5 wherein the patient transfer mechanism is fixed to or near the top or upper portion of the first shaft and pivotable about the first shaft.

19. A patient service unit according to claim 4 wherein the patient service element is a drawer and the unit further includes a drawer enclosure mounted around the storage drawer and fixed in position relative to the second shaft such that the drawer is rotatable around the second shaft and relative to the drawer enclosure.

* * * * *